US007243624B2

(12) United States Patent
Kenchington

(10) Patent No.: US 7,243,624 B2
(45) Date of Patent: Jul. 17, 2007

(54) ELECTRICALLY OPERATED VALVE FOR CONTROLLING FLOW OF HYDRAULIC FLUID

(75) Inventor: Steven Kenchington, Norfolk (GB)

(73) Assignee: Lotus Cars Limited, Norfolk (GB)

( * ) Notice: Subject to any disclaimer, the term of this patent is extended or adjusted under 35 U.S.C. 154(b) by 46 days.

(21) Appl. No.: 10/522,266

(22) PCT Filed: Jul. 30, 2003

(86) PCT No.: PCT/GB03/03301

§ 371 (c)(1),
(2), (4) Date: Aug. 10, 2005

(87) PCT Pub. No.: WO2004/011781

PCT Pub. Date: Feb. 5, 2004

(65) Prior Publication Data

US 2006/0011060 A1 Jan. 19, 2006

(30) Foreign Application Priority Data

Jul. 30, 2002 (GB) ..... 0217642.8

(51) Int. Cl.
*F01L 9/02* (2006.01)

(52) U.S. Cl. ..... 123/90.12; 123/90.13; 123/90.15; 137/625

(58) Field of Classification Search ..... 123/90.12, 123/90.13, 90.15, 90.17; 137/625, 625.65, 137/625.69, 625.34
See application file for complete search history.

(56) References Cited

U.S. PATENT DOCUMENTS 2,630,136 A 3/1953 Brandes et al.
3,696,836 A 10/1972 Bauer
5,829,396 A * 11/1998 Sturman ..... 123/90.12

(Continued)

FOREIGN PATENT DOCUMENTS

GB 1324456 7/1973

(Continued)

OTHER PUBLICATIONS

British Search Report; dated Feb. 27, 2003, pp. 10-12.

(Continued)

*Primary Examiner*—Ching Chang
(74) *Attorney, Agent, or Firm*—Fulwider Patton LLP

(57) ABSTRACT

The present invention relates to an electrically operated valve (10), which has a valve housing (11); a spool (12); a first fluid conduit (14) connecting the valve (10) with a source of pressurized fluid; a second fluid conduit (15) connecting the valve (10) with a reservoir of fluid; and a third fluid conduit (16) in communication with valve (10) which delivers fluid to or receives fluid from apparatus which uses the hydraulic fluid flow controlled by the valve (10). The spool (12) is biased to a rest position by a pair of opposed springs (17,18) and in the rest position closes off the first (14) and second (15) fluid conduits. A first electric coil (19) associated with a first end of the spool (12) when activated displaces the spool (12) to open the first fluid conduit (14). A second electric coil (20) associated with a second end of the spool (12) when activated displaces the spool (12) to open the second fluid conduit (15).

22 Claims, 2 Drawing Sheets

U.S. PATENT DOCUMENTS

| | | | |
|---|---|---|---|
| 5,881,689 | A | 3/1999 | Hochholzer |
| 6,067,946 | A | 5/2000 | Bunker et al. |
| 6,170,524 | B1 | 1/2001 | Gray, Jr. |
| 6,173,685 | B1 | 1/2001 | Sturman |

FOREIGN PATENT DOCUMENTS

| | | |
|---|---|---|
| JP | 580032985 | 2/1983 |
| JP | 08049659 | 2/1996 |
| JP | 11257504 | 9/1999 |
| JP | 2002195425 | 7/2002 |
| WO | WO 0246582 | 6/2002 |

OTHER PUBLICATIONS

British Examination Report; dated Jul. 2, 2004, pp. 1-2.

* cited by examiner

ELECTRICALLY OPERATED VALVE FOR CONTROLLING FLOW OF HYDRAULIC FLUID

RELATED APPLICATIONS

This application is a U.S. National phase of PCT/GB2003/003301, filed 30 Jul. 2003, which claims priority from Great Britain Application Serial No. 0217642.8, filed Jul. 30, 2002.

The present invention relates to an electrically operated valve for controlling flow of hydraulic fluid.

The present invention will be discussed with particular reference to the use of valves for controlling flow of hydraulic fluid to actuators attached to engine valves of an internal combustion engine. It has often been suggested in the past that in an internal combustion engine a mechanical cam shaft could be replaced by a series of hydraulic actuators which would open and close the engine valve. The hydraulic actuators are controlled by controlling the flow of hydraulic fluid to them. Various different arrangements of valves have been proposed for the control of hydraulic fluid. However, there is still a need for a simple and cost-effective valve arrangement and this issue is addressed by the present invention.

The present invention provides an electrically operated valve for controlling flow of hydraulic fluid comprising:

a valve housing;

a spool slidable in a spool chamber in the valve housing;

a first fluid conduit extending through the valve housing for connecting the spool chamber with a source of pressurized fluid;

a second fluid conduit extending through the valve housing for connecting the spool chamber with a reservoir of fluid; and a third fluid conduit in communication with the spool chamber which delivers fluid to or receives fluid from apparatus which uses the hydraulic fluid flow controlled by the valve; wherein:

the spool is biased to a rest position by a pair of opposed springs;

the spool in the rest position thereof closes off the first and second fluid conduits from the spool chamber and thereby prevents flow of fluid to and from the third fluid conduit;

the valve has a first electric coil associated with a first end of the spool and which can be activated to displace the spool from the rest position thereof to open the first fluid conduit to the spool chamber, whilst keeping closed the second fluid conduit, and thereby to allow pressurized fluid to flow from the first fluid conduit to the third fluid conduit; and the valve has a second electric coil associated with a second end of the spool and which can be activated to displace the spool from the rest position thereof to open the second fluid conduit to the spool chamber, whilst keeping closed the first fluid conduit, and thereby to allow fluid to flow from the third fluid conduit to the second fluid conduit.

A preferred embodiment of the present invention will now be described with reference to the accompanying drawings in which.

Figure 1:
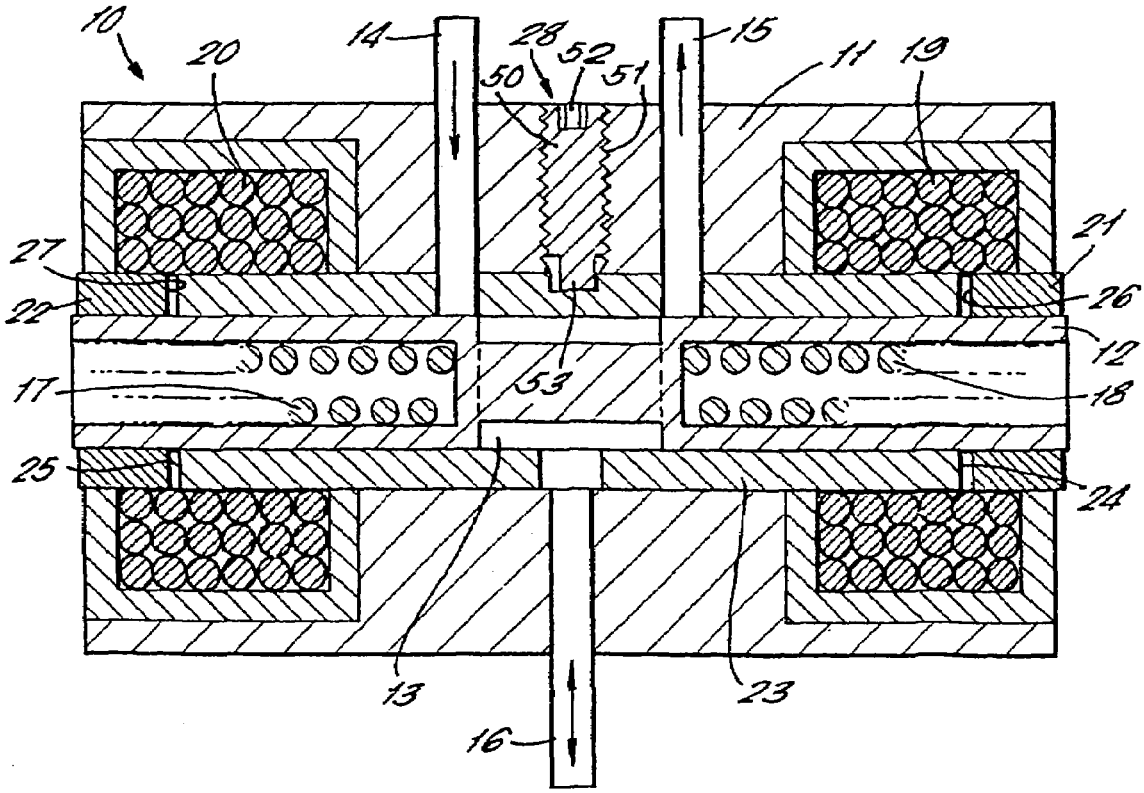
FIG. 1 is a schematic illustration of an electrically operated valve for controlling flow of hydraulic fluid according to a preferred embodiment of the present invention.

Turning first to FIG. 1 there can be seen an electrically operated valve 10 controlling the flow of hydraulic fluid there through. The valve 10 comprises a valve housing 11 having slidable therein a spool 12, the spool being slidable in a spool chamber 13 provided in the valve housing 11.

A first fluid conduit 14 extends through the valve housing 11 and connects the spool chamber 13 with a source of pressure.

A second fluid conduit 15 extends through the valve housing 11 and connects the spool chamber 13 with a return line for returning hydraulic fluid to a reservoir.

A third fluid conduit 16 extends through the valve housing 11 and connects the valve 10 to whatever apparatus receives the flow of hydraulic fluid controlled by the valve 10.

In FIG. 1 there can be seen two opposed springs 17 and 18 which together act to center a spool 12. When the spool 12 is centered both springs will still be compressed and will still each apply a force on the spool 12, but the forces applied by the two springs 17 and 18 will be equal and opposite.

Two electric coils 19 and 20 surround the ends of the spool 12. Surrounding each end of the spool 12 there is provided an armature 21 and 22.

The spool 12 is surrounded by a sleeve 23. This sleeve 23 has two annular end surfaces 24 and 25. The annular end surface 24 faces an annular end surface 26 of the armature 21. The annular surface 25 faces an annular surface 27 of the armature 22.

When the electric coil 20 is actuated then the magnetic circuit acts to draw the armature 22 into engagement with the annular surface 25 of the sleeve 23. Thus, the spool valve is moved to the right of its position shown in FIG. 1, against the biasing force of the spring 18.

When the electric coil 19 is activated then the magnetic field generated by the coil acts to draw the armature 21 towards the annular surface of the sleeve 23 and thereby move the spool 12 to the left of its position in FIG. 1, against the biasing force of the spring 17.

With the spool 12 positioned as shown in FIG. 1 the pressure line 14 and the return line 15 are both sealed off from the spool chamber 13 and therefore no hydraulic fluid can flow to or from the fluid conduit 16.

When the spool 12 is moved to the right of its position in FIG. 1 then the fluid conduit 16 is connected via the spool chamber 13 with the return line 15 and therefore fluid can flow from the line 16 through the spool chamber 13 to the fluid conduit 15 and thereby to a reservoir of hydraulic fluid.

When the spool 12 is moved to the left of its position in FIG. 1 then the conduit 14 is opened to the spool chamber 13 whilst the conduit 15 remains sealed. Thus, pressurized fluid can flow through the conduit 14 to the conduit 16 via the spool chamber 13.

The fluid conduit 16 is permanently open to the spool chamber 13.

In FIG. 1 there can be seen a null adjust mechanism 28. This comprises an externally threaded rotatable screw 50 provided in a threaded bore 51 in the valve housing 11. A hexagonal socket 52 is provided at the tip of the screw 50 and can be engaged and rotated by an Allen key. An eccentric cam 53 extends downwardly from the screw 50 and acts on a reaction surface provided on the sleeve 23. On rotating the cam 53 it is possible to slide the sleeve 23 within the valve housing 11. This can be done to ensure that when the two electric coils 19, 20 are deactivated and the spool 12 brought to a central position by the two springs 17 and 18, then the ports in the sleeve 23 via which the pressure line 14 and the return line 15 open onto the spool chamber 13 are both closed off by the spool 12.

By having a high pre-load applied on the spool 12 in its resting position by both the spring 17 and the spring 18, with the forces applied by the springs cancelled out by each other, it is possible to set a low spring rate and to determine how much force must be applied to move the spool valve 12 from its centralized position. This feature allows the valve to be used easily as a metering valve, because the current flowing through each of the electrical coils 20 or 21 can be adjusted to give a variable displacement of the valve spool 12, a variable degree of opening of the ports in the sleeve 23 and therefore a variable rate of flow through the valve 10. However, if wished, the valve 10 could operate as a switching valve, moving only between extreme positions by applying high value square-wave signals to the coils 19 and 20.

Figure 2:
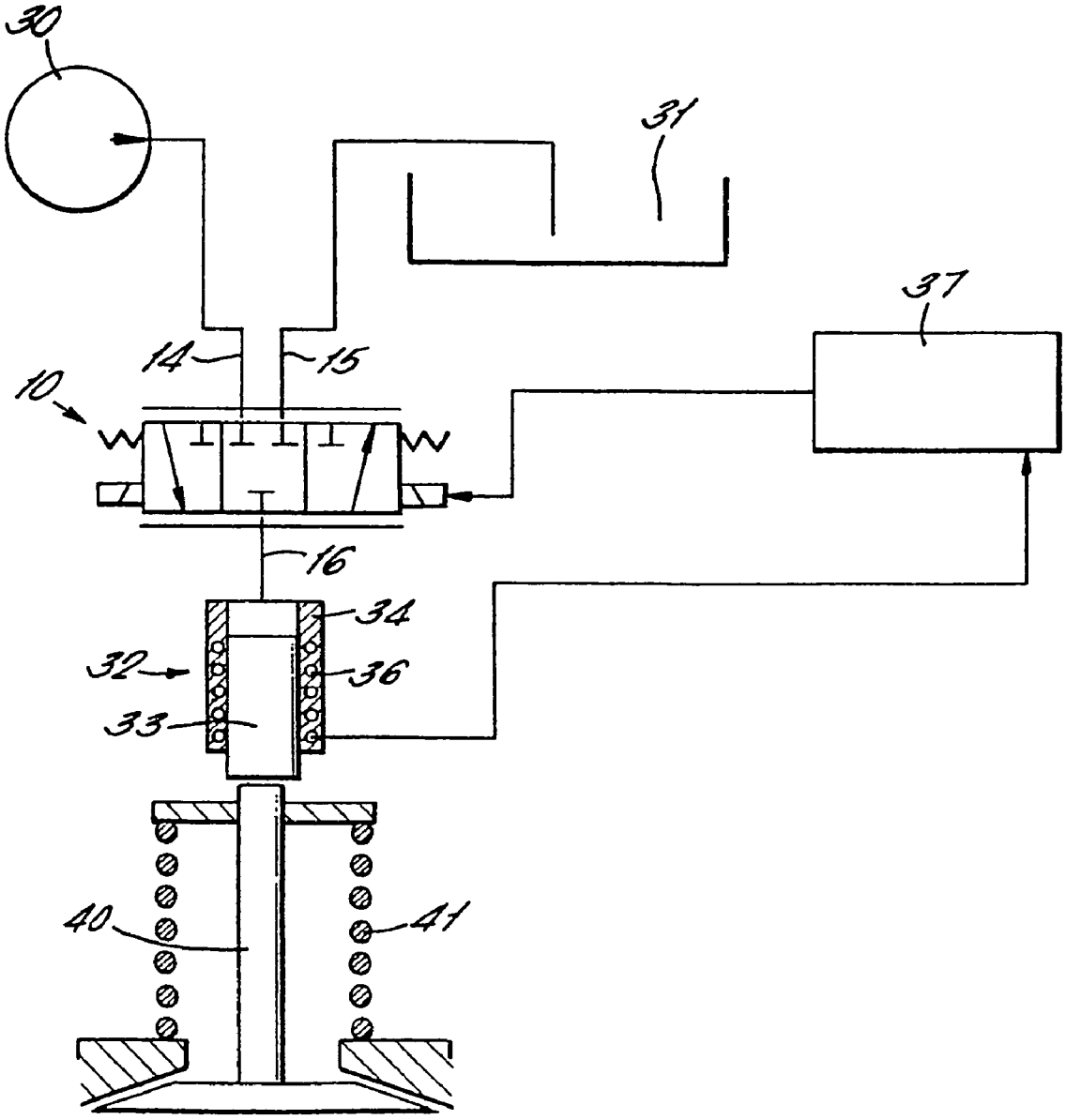
FIG. 2 is a schematic illustration of how the valve of FIG. 1 could be used in an internal combustion engine.

Moving now to FIG. 2, the valve 10 can be seen represented schematically. The pressure line 14 is shown connected to a pump 30 and the return line 15 is shown connected to a reservoir 31. The line 16 is shown connected to an actuator 32. The actuator 32 comprises a piston 33 movable in a cylinder defined by a sleeve 34. Piston 33 and the sleeve 34 define together a variable volume chamber 35 which receives hydraulic fluid via the line 16.

A position sensor 36 is built into the sleeve 34 and provides a feed back signal to an electronic controller 37. The electronic controller 37 uses the feedback signal along with other received parameters to provide a control signal which is relayed to the valve 10. As explained before, the control signal will be used to apply a current to one of the two coils 20 and 19.

When the actuator 32 is connected to the pump 30 via the valve 10 then the piston 33 is caused to move downwardly and to open an engine valve 40 of an internal combustion engine, (e.g. An inlet or an exhaust valve).

When the actuator 32 is connected to the reservoir 31 via the valve 10 then a valve spring 41 acting on the engine valve 40 can force the piston 33 to reduce in volume the chamber defined between piston 33 and sleeve 34, with the dispelled fluid being relayed via the valve 10 to the reservoir 31.

The electronic controller 37 is part of a closed-loop feedback system which controls the position of the engine valve 40. The electronic controller 37 will send a demand signal to the valve 10 in the expectation that this will result in a position (and perhaps a rate of change of position) of the piston 33 and therefore the engine valve 40. The displacement transducer 36 will provide a signal which can be used to generate an error signal so that the electronic controller 37 can adjust the control signal it sends to the valve 10.

The use of feedback signal is important since the provision of a closed loop feedback system can provide for adaptive control, with the electronic controller making adjustments during the life of an engine to account for wear of components in the engine.

Whilst above the armatures 21, 22 are movable within the electric coils 19, 20 they could be formed as radially extending plates each with a surface facing an opposed end face of a coil 19, 20 (either an in board or an outboard end face of a coil). The housing 11 would be provided with suitable chambers adjacent the coils 19, 20 in which the radially extending armatures could move. Whilst the springs 17, 18 are shown within bores in the spool 17, they could be mounted externally of the spool (perhaps in the spool chamber) if more conveniently.

The rate of opening of the valve 40 and the rate of closing of the valve 40 can be controlled by controlling the rate of flow of fluid through the valve 10.

The invention claimed is:

1. An electrically operated valve for controlling flow of hydraulic fluid to or from apparatus which uses the hydraulic fluid flow controlled by the valve, the valve comprising:

a valve housing;

a spool slidable in a spool chamber in the valve housing;

a first fluid conduit extending through the valve housing for connecting the spool chamber with a source of pressurized fluid;

a second fluid conduit extending through the valve housing for connecting the spool chamber with a reservoir of fluid; and a third fluid conduit in communication with the spool chamber which delivers fluid to or receives fluid from the apparatus which uses the hydraulic fluid flow controlled by the valve; wherein:

the spool is biased to a rest position by a pair of opposed springs;

the spool in the rest position thereof closes off the first and second fluid conduits from the spool chamber and thereby prevents flow of fluid to and from the third fluid conduit;

the valve has a first electric coil associated with a first end of the spool and which can be activated to displace the spool from the rest position thereof to open the first fluid conduit to the spool chamber, whilst keeping closed the second fluid conduit, and thereby to allow pressurized fluid to flow from the first fluid conduit to the third fluid conduit; and the valve has a second electric coil associated with a second end of the spool and which can be activated to displace the spool from the rest position thereof to open the second fluid conduit to the spool chamber, whilst keeping closed the first fluid conduit, and thereby to allow fluid to flow from the third fluid conduit to the second fluid conduit;

wherein a sleeve surrounds the spool and defines the spool chamber in which the spool is slidable, the sleeve having a first port through which the first fluid conduit communicates with the spool chamber, a second port through which the second fluid conduit communicates with the spool chamber and a third port through which the third fluid conduit communicates with the spool chamber, and wherein the valve has an adjustment mechanism for sliding the sleeve relative to the valve housing.

2. An electrically operated valve as claimed in claim 1 wherein the pair of opposed springs each apply a force on the spool when the spool valve is in the rest position thereof.

3. An electrically operated valve as claimed in claim 2 wherein the spool has mounted thereon an armature surrounding the first end of the spool and displace able within the first electric coil and the spool has mounted thereon an armature surrounding the second end of the spool and displace able within the second electric coil.

4. A method of operating the electrically operated valve claimed in claim 2, the method comprising:

selecting between the first and second coils and activating the first electric coil when pressurized fluid is to be relayed on to the apparatus using the hydraulic fluid flow and activating the second electric coil when fluid is to be returned from the apparatus using the hydraulic fluid flow back to the reservoir; and controlling the current through and/or voltage across each electric coil when activated in order to control rate of flow of fluid through the valve.

5. An engine valve operating system comprising:

an actuator which acts on an engine valve and can be extended to open the engine valve and retracted to allow the engine valve to close under the action of an engine valve spring;

an electrically operated valve as claimed in claim 2 controlling flow of hydraulic fluid to and from the actuator; and an electronic controller for controlling the actuator.

6. An engine valve operating system as claimed in claim 5 wherein:

the actuator comprises a piston movable in a cylinder;

the system comprises additionally a position transducer which produces a position signal indicative of the position of the piston; and the electronic controller uses the position signal to generate an error signal and thereby provides a closed loop control system for the actuator.

7. An electrically operated valve as claimed in claim 2 wherein the adjustment mechanism comprises a rotatable cam which engages a reaction surface provided on the sleeve.

8. An electrically operated valve as claimed in claim 7 wherein the spool has mounted thereon an armature surrounding the first end of the spool and displaceable within the first electric coil and the spool has mounted thereon an armature surrounding the second end of the spool and displaceable within the second electric coil.

9. A method of operating the electrically operated valve claimed in claim 8, the method comprising:

selecting between the first and second coils and activating the first electric coil when pressurized fluid is to be relayed on to the apparatus using the hydraulic fluid flow and activating the second electric coil when fluid is to be returned from the apparatus using the hydraulic fluid flow back to the reservoir; and controlling the current through and/or voltage across each electric coil when activated in order to control rate of flow of fluid through the valve.

10. An engine valve operating system comprising:

an actuator which acts on an engine valve and can be extended to open the engine valve and retracted to allow the engine valve to close under the action of an engine valve spring;

an electrically operated valve as claimed in claim 8 controlling flow of hydraulic fluid to and from the actuator; and an electronic controller for controlling the actuator.

11. An engine valve operating system as claimed in claim 10 wherein:

the actuator comprises a piston movable in a cylinder;

the system comprises additionally a position transducer which produces a position signal indicative of the position of the piston; and the electronic controller uses the position signal to generate an error signal and thereby provides a closed loop control system for the actuator.

12. An electrically operated valve as claimed in claim 2 wherein the opposed springs both engage the spool valve directly, are both compressed when the spool valve is in the rest position and when the spool is moved from the rest position one of the springs is further compressed while the other of the springs extends.

13. An electrically operated valve as claimed in claim 1 wherein the adjustment mechanism comprises a rotatable cam which engages a reaction surface provided on the sleeve.

14. An electrically operated valve as claimed in claim 13 wherein the spool has mounted thereon an armature surrounding the first end of the spool and displaceable within the first electric coil and the spool has mounted thereon an armature surrounding the second end of the spool and displaceable within the second electric coil.

15. A method of operating the electrically operated valve claimed in claim 13, the method comprising:

selecting between the first and second coils and activating the first electric coil when pressurised fluid is to be relayed on to the apparatus using the hydraulic fluid flow and activating the second electric coil when fluid is to be returned from the apparatus using the hydraulic fluid flow back to the reservoir; and controlling the current through and/or voltage across each electric coil when activated in order to control rate of flow of fluid through the valve.

16. An engine valve operating system comprising:

an actuator which acts on an engine valve and can be extended to open the engine valve and retracted to allow the engine valve to close under the action of an engine valve spring;

an electrically operated valve as claimed in claim 13 controlling flow of hydraulic fluid to and from the actuator; and an electronic controller for controlling the actuator.

17. An electrically operated valve as claimed in claim 1 wherein the spool has mounted thereon an armature surrounding the first end of the spool and displaceable within the first electric coil and the spool has mounted thereon an armature surrounding the second end of the spool and displaceable within the second electric coil.

18. A method of operating the electrically operated valve claimed in claim 1, the method comprising:

selecting between the first and second coils and activating the first electric coil when pressurized fluid is to be relayed on to the apparatus using the hydraulic fluid flow and activating the second electric coil when fluid is to be returned from the apparatus using the hydraulic fluid flow back to the reservoir; and controlling the current through and/or voltage across each electric coil when activated in order to control rate of flow of fluid through the valve.

19. An engine valve operating system comprising:

an actuator which acts on an engine valve and can be extended to open the engine valve and retracted to allow the engine valve to close under the action of an engine valve spring;

an electrically operated valve as claimed in claim 1 controlling flow of hydraulic fluid to and from the actuator; and an electronic controller for controlling the actuator.

20. An engine valve operating system as claimed in claim 19 wherein:

the actuator comprises a piston movable in a cylinder;

the system comprises additionally a position transducer which produces a position signal indicative of the position of the piston; and the electronic controller uses the position signal to generate an error signal and thereby provides a closed loop control system for the actuator.

21. An engine valve operating system as claimed in claim 19 wherein:

the actuator comprises a piston movable in a cylinder;

the system comprises additionally a position transducer which produces a position signal indicative of the position of the piston; and the electronic controller uses the position signal to generate an error signal and thereby provides a closed loop control system for the actuator.

22. An electrically operated valve for controlling flow of hydraulic fluid to or from apparatus which uses the hydraulic fluid flow controlled by the valve, the valve comprising:

a valve housing;

a spool slidable in a spool chamber in the valve housing;

a first fluid conduit extending through the valve housing for connecting the spool chamber with a source of pressurized fluid;

a second fluid conduit extending through the valve housing for connecting the spool chamber with a reservoir of fluid; and a third fluid conduit in communication with the spool chamber which delivers fluid to or receives fluid from the apparatus which uses the hydraulic fluid flow controlled by the valve; wherein:

the spool is biased to a rest position by a pair of opposed springs;

the spool in the rest position thereof closes off the first and second fluid conduits from the spool chamber and thereby prevents flow of fluid to and from the third fluid conduit;

the valve has a first electric coil associated with a first end of the spool and which can be activated to displace the spool from the rest position thereof to open the first fluid conduit to the spool chamber, whilst keeping closed the second fluid conduit, and thereby to allow pressurized fluid to flow from the first fluid conduit to the third fluid conduit; and the valve has a second electric coil associated with a second end of the spool and which can be activated to displace the spool from the rest position thereof to open the second fluid conduit to the spool chamber, whilst keeping closed the first fluid conduit, and thereby to allow fluid to flow from the third fluid conduit to the second fluid conduit;

wherein the opposed springs both engage the spool valve directly, are both compressed when the spool valve is in the rest position and when the spool is moved from the rest position one of the springs is further compressed while the other of the springs extends.

* * * * *

UNITED STATES PATENT AND TRADEMARK OFFICE

CERTIFICATE OF CORRECTION

PATENT NO. : 7,243,624 B2
APPLICATION NO. : 10/522266
DATED : July 17, 2007
INVENTOR(S) : Steven Kenchington It is certified that error appears in the above-identified patent and that said Letters Patent is hereby corrected as shown below:

Column 1,
Line 67, delete “there through” and insert --therethrough--.

Column 4,
Lines 48 and 51, delete “displace able” and insert --displaceable--.

Signed and Sealed this
Fifteenth Day of February, 2011

David J. Kappos

David J. Kappos
*Director of the United States Patent and Trademark Office*